United States Patent [19]

Watanabe et al.

[11] Patent Number: 4,785,649

[45] Date of Patent: Nov. 22, 1988

[54] TAPERED THREAD ROLL-FORMING MACHINE

[75] Inventors: Takashi Watanabe, Warabi; Shigeyoshi Tanaka, Osaka, both of Japan

[73] Assignee: Kabushiki Kaisha Watanabe Kogyo, Saitama, Japan

[21] Appl. No.: 935,720

[22] Filed: Nov. 28, 1986

[51] Int. Cl.[4] ..... B21H 3/02; B21H 9/02

[52] U.S. Cl. ..... 72/104; 72/110; 72/107; 10/96 T

[58] Field of Search ..... 72/104, 106, 108, 107, 72/110, 121; 408/48, 173, 178; 10/96 T

[56] References Cited

U.S. PATENT DOCUMENTS

| | | | |
|---|---|---|---|
| 591,324 | 10/1897 | Carstensen | 408/173 |
| 896,665 | 8/1908 | Rider | 408/151 |
| 2,704,950 | 3/1955 | Scott | 72/104 |
| 2,819,631 | 1/1958 | Scott et al. | 72/104 |
| 3,091,142 | 5/1963 | Szikla | 72/107 |
| 3,693,390 | 9/1972 | Oehm | 72/107 |
| 3,972,213 | 8/1976 | Habegger | 72/121 |

FOREIGN PATENT DOCUMENTS

| | | | |
|---|---|---|---|
| 2538701 | 4/1976 | Fed. Rep. of Germany | 72/107 |
| 135040 | 4/1980 | Fed. Rep. of Germany | 72/102 |
| 550209 | 4/1979 | U.S.S.R. | 72/104 |
| 735370 | 5/1980 | U.S.S.R. | 72/102 |
| 1277278 | 6/1972 | United Kingdom | 72/121 |

*Primary Examiner*—Lowell A. Larson

*Attorney, Agent, or Firm*—Stevens, Davis, Miller & Mosher

[57] ABSTRACT

An apparatus for forming tapered threads to a workpiece such as a pipe comprises a casing and a supporting member attached to one side of the casing, and three support plates rotatably attached to the supporting member. Roller members or cam members are secured to the support plates, respectively, to be rotatable with respect thereto and rolling dies are also secured to the support plates. The rolling dies are rotated by an electric motor through a power transmission mechanism. The workpiece is inserted into a space defined by the supporting dies to be subjected to the roll-forming operation.

6 Claims, 3 Drawing Sheets

TAPERED THREAD ROLL-FORMING MACHINE

BACKGROUND OF THE INVENTION

This invention relates to a thread roll-forming machine and, more particularly, to an apparatus for forming tapered threads to a workpiece such as gas pipes and pipe fittings.

FIG. 1 shows a typical example of a conventional pipe or a pipe fitting, which has tapered screwthreads b formed at one open end a1 of a body a. Due to the fact that the tapered screwthreads b are formed by means of the threading dies, the one end a1 of the body a has a decreased thickness towards the opening end and since the material is removed away from the pipe, the effective strength of the screw heads may be adversely affected.

In the meantime, the tapered screwthreads b of the pipe body a shown in FIGS. 2 and 3 are produced by the rolling dies of a thread roll-forming machine. The screw threads b of the pipe of this type are usually formed by pressing the rolling dies without cutting the threads, so that the composition of the material will not be damaged and the effective strength of the screw heads is also not weakened. On the other hand, since a conventional thread roll-forming machine for pipes has a die supporting mechanism for supporting the rolling dies which is constructed so that a link mechanism and a cam mechanism are cooperative. This construction results in the increasing in the number of component parts, and complexity of the structure of the machine itself. Moreover, machine assembly and adjustment get complicated and maintenance time and labor are made troublesome. The machine becomes bulky as a whole structure which requires much space, thus being difficult to handle the same and to transfer the machine to a place for the installation thereof.

SUMMARY OF THE INVENTION

Accordingly, it is the primary object of the present invention to eliminate the difficulties encountered with the conventional thread roll-forming machine and to provide a thread roll-forming machine which is compact-and light weight-type for easy portablity and for easy handling, thereby to form tapered threads to the pipe with a variety of sizes with the employment of exchangeable thread rolling dies.

These and other objects are achieved, according to this invention, by providing an apparatus for forming tapered threads to a workpiece such as a pipe which comprises a casing, a supporting member of ring shape secured to one side of the casing and provided with three arcuate guide slots at an outer peripheral portion of the supporting member, a rotatable member located between one side of the casing and the supporting member and supported thereby, three pins each having one end embedded in the rotatable member through corresponding one of the guide slots and the other end on which a roller is mounted, three support plates each pivotably attached to the supporting member and provided with cam means abutted against corresponding one of rollers of the pins, three rolling dies rotatably attached to the support plates, respectively, and means for driving the rolling dies through a power transmission mechanism thereby to rotate the rolling dies.

In another embodiment, cam means are provided to the rotatable member and these cam means abut against roller means rotatably attached to the support plates, respectively. In a further embodiment, other cam members are located to the supporting member to be rotatable without locating the roller means and these cam members abut against the cam means provided to the support plate.

DESCRIPTION OF THE PREFERRED EMBODIMENTS

The details of the embodiments of the current invention will hereinafter be disclosed with reference to FIGS. 4 through 7.

Figure 1:
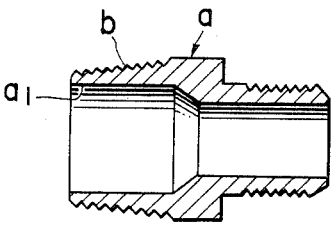
FIG. 1 PRIOR ART
FIGS. 1 to 3 show pipe fittings having tapered threads formed according to the prior art technique.
Figure 2:
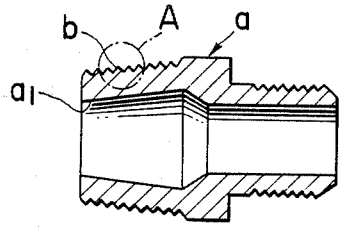
FIG. 2 PRIOR ART
Figure 3:
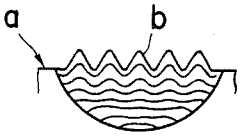
FIG. 3 PRIOR ART
Figure 4:
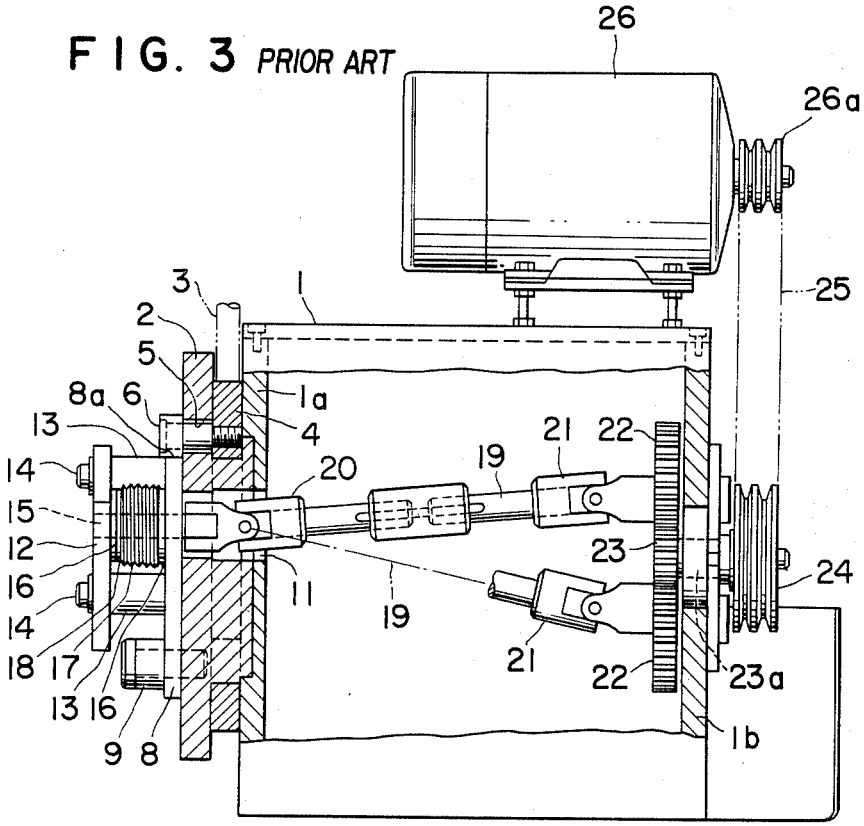
FIG. 4 shows a sectional elevation, partially broken off, of the thread roll-forming machine according to the present invention.
Figure 5:
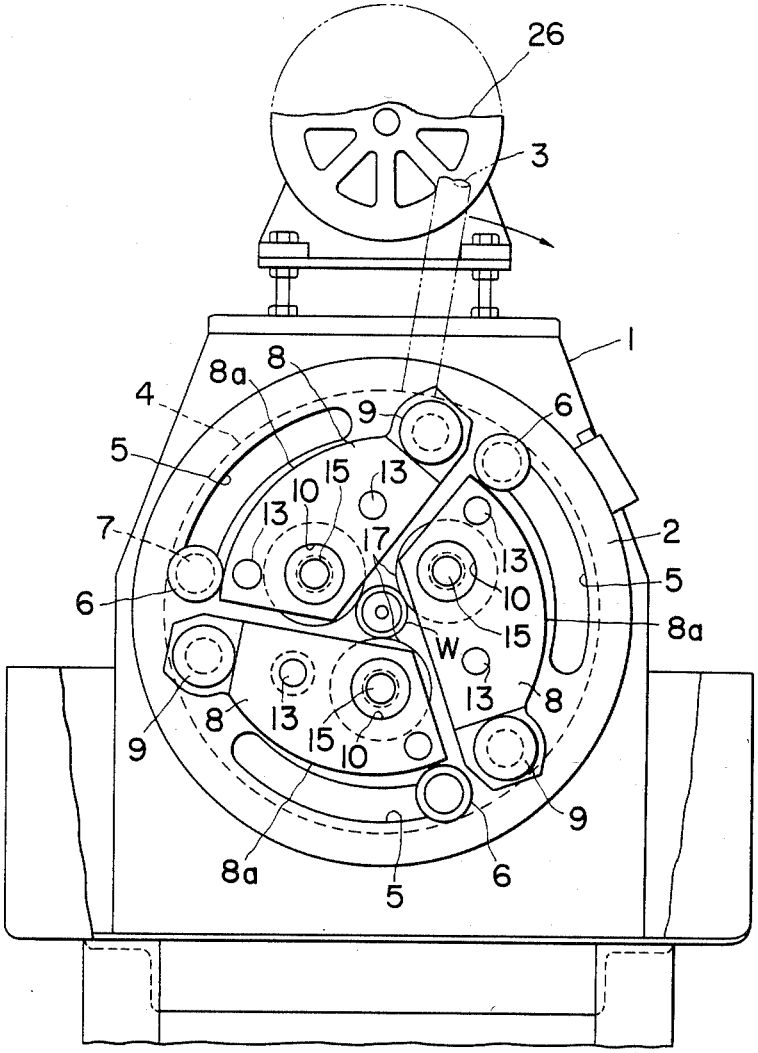
FIG. 5 shows a front elevation of the thread roll-forming machine as shown in FIG. 4 with a holding member 12 removed for purposes of clarity.

Referring to FIGS. 4 and 5, the machine comprises a case body 1, to which a disc-shaped ring supporter 2 is connected at the front end 1a thereof. A rotatable member 4 provided with an integrally formed handle 3 is fitted to the ring supporter 2 so as not to slip out outwardly. On the peripheral portion of the ring supporter 2, are formed at least three arcuate guide slots 5 which are substantially equally spaced apart (FIG. 5). The rotatable member 4 is provided with three roller pins 7 so as to extend through guide slots 5 to respectively support rollers 6. At least three die supporting plates 8 are located in the vicinity of the arcuate guide slots 5. The respective die supporting plates 8 are pivoted about shafts 9 to be rotatable toward the central axis thereof. Each die supporting plate 8 is provided with a through hole 10. The ring supporter 2 is also provided with three through holes 11 at positions corresponding to the respective locations of the through holes 10. The outer peripheral surface of each die supporting plate 8 forms a cam 8a so as to be pushed by the corresponding roller 6 towards the central axis of the apparatus 8.

As shown in FIG. 4, a holding member 12 is fixed in front of the die supporting plate 8 by means of a fastener 14 at the predetermined distance therefrom with a spacer 13. A spline shaft 15 is fitted to the holding member 12 to be rotatable through the corresponding through hole 10. On the outer peripheral portion of the respective spline 15 between the die supporting plate 8 and the holding member 12 are detachably mounted, for example, a helix plate 16 for forming tapers, a thread rolling die 17 and a spacer 18 by means of rolling dies.

The end of the each spline 15 is connected to a universal joint 20 for a driving shaft 19. The other end of the driving shaft 19 is connected to another universal joint 21 which is further coupled to a follower gear 22 (three gears in the illustrated embodiment). The follower gear 22 is supported by the back plate 1*b* of the casing 1 and is meshed with a driving gear 23 which is also provided inside the back plate 1*b*. The driving gear 23 has a driving shaft 23*a* which is rotated via a pulley 24 mounted on the shaft 23*a* through a driving belt 25 engaged with an output shaft 26*a* of an electric motor 26 and the pulley 24.

As shown in FIG. 5, a work W on which tapered screw threads are formed in preliminarily held by the inserting portion surrounded by the rolling dies 17.

In operation, when the motor 26 is driven, the rolling dies 17 are rotated together with the work W via the driving shaft 19, and simultaneously, the rotatable member 4 integrally formed therewith is also rotated by rotating the handle 3. The roller 6 fixed upon the member 4 is then moved clockwisely along the arcuate guide slot 5 as shown in FIG. 5 and pushes the cam 8*a*, thereby transferring the rolling dies 17 in the direction towards the central axis thereof to engage with the external surface of the work W thereby to produce the tapered screw threads.

Although in the aforesaid embodiment, the rolling dies 17 are referred to in the use of rolling dies and helix plate 16, the other types of thread rolling dies 17 having helical screw threads may be employed without departing from the basic concept of this invention.

Figure 6:
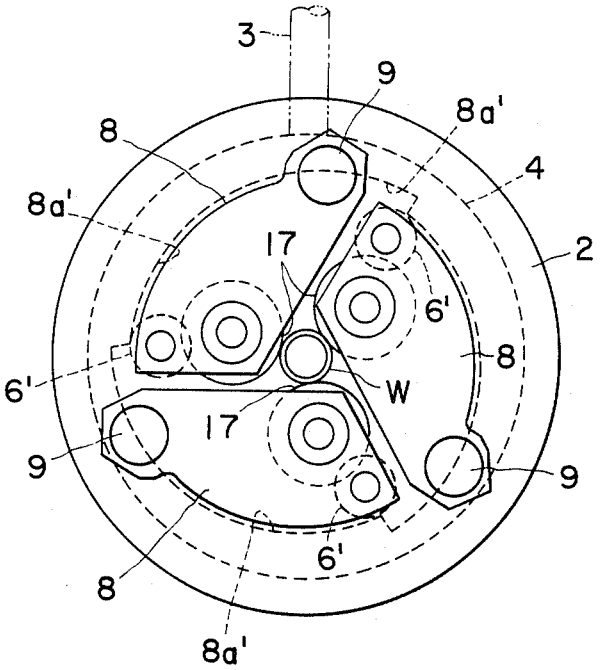
FIGS. 6 and 7 show other embodiments of the present invention.

FIG. 6 shows another embodiment of the present invention, in which rollers 6' are integrally supported by the corresponding die supporting plate 8, respectively, while the cam portions 8*a'* being formed on the internal peripheral surface of the rotatable members 4. The basic operation of these members are substantially identical with that described with respect to the former embodiment.

Figure 7:
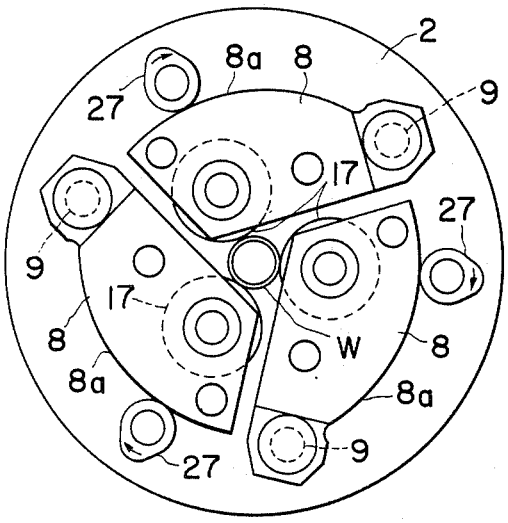

FIG. 7 also shows a further embodiment of this invention, in which a cam member 27 is formed on the ring supporter 2 so as to abut against the cam surface 8*a* of the die supporting plate 8. The operation of this embodiment is also substantially the same as those of the foregoing embodiments.

As described hereinbefore, in accordance with this invention, the ring supporter 2 is provided at one end surface 1a of the casing 1, and the rotatable member 4 is fitted thereto so as to prevent itself from slipping out. A set of at least three die supporting plates 8 is provided upon the ring supporter 2 and the thread rolling die 17 is detachably mounted on one end of the die supporting plate 8. Moreover, to either one end surface of the die supporting plate 8 or the rotatable member 4 is formed a cam surface 8*a* or 8*a'*, while the roller 6 or 6' is rotatably provided either upon the die supporting plate 8 or the rotatable member 4. Accordingly, the overall machine can be easily transferred to the site of pipe installation to handle and operate the same there. In addition, pipes of various sizes or dimensions can be worked upon with the easy exchange of the thread rolling dies.

What is claimed is:

1. An apparatus for forming tapered threads to a workpiece such as a pipe comprising:

a casing;

a supporting member of ring shape secured to one side of said casing and provided with at least three guide slots at an outer peripheral portion of said supporting member;

a rotatable member located between said one side of the casing and said supporting member and supported thereby;

means attached to said rotatable member, for rotating said rotatable member;

at least three pins, each having one end embedded in said rotatable member and extending through a corresponding guide slot and another end on which a roller is mounted;

at least three support plates each pivotably attached to said supporting member and provided with cam means abutted against a corresponding one of said rollers of said pins;

at least three rolling dies, each die being rotatably attached to one of said support plates, respectively, said rolling dies having thread forming means thereon;

means connected to each of said rolling dies for driving said rolling dies through a power transmission mechanism thereby to rotate said rolling dies.

2. The apparatus according to claim 1 wherein said guide slots are arcuate and symmetrically arranged about an axis of said support member.

3. The apparatus according to claim 1 wherein said rotatable member is provided with a handle which rotates the rotatable member when said rolling dies are rotated.

4. The apparatus according to claim 1 wherein respective three support plates are located symmetrically about an axis of said support member in association with three cam means and three rolling dies, respectively.

5. An apparatus for forming tapered threads to a workpiece such as a pipe comprising:

a casing;

a non-rotatable support member or ring shape secured to one side of said casing;

at least three support plates each pivotably attached to said support member and provided with a cam surface;

at least three cam means rotatably supported to said support member so as to abut against said cam surfaces provided to said support plates, respectively;

at least three rolling dies rotatably attached to said support plates, respectively; and means connected to each of said rolling dies for driving said rolling dies through a power transmission mechanism thereby to rotate said rolling dies.

6. The apparatus according to claim 5 wherein respective three support plates are located symmetrically about an axis of said support member in association with said three cam means and three rolling dies, respectively.

* * * * *